US005236554A

United States Patent [19]

Greenwood

[11] Patent Number: 5,236,554

[45] Date of Patent: Aug. 17, 1993

[54] DIGESTER HAVING PLURAL SCREENS WITH MEANS FOR CONTROLLING LIQUID INJECTION AND WITHDRAWAL

[75] Inventor: Brian F. Greenwood, Glens Falls, N.Y.

[73] Assignee: Kamyr, Inc., Glens Falls, N.Y.

[21] Appl. No.: 746,344

[22] Filed: Aug. 16, 1991

[51] Int. Cl.[5] ..... D21C 7/12

[52] U.S. Cl. ..... 162/238; 162/248; 162/249; 162/251

[58] Field of Search ..... 162/17, 37, 39, 251, 162/248, 249, 238; 210/334, 420, 422; 422/110, 111

[56] References Cited

U.S. PATENT DOCUMENTS

| | | | |
|---|---|---|---|
| 2,414,062 | 1/1947 | Richter | 162/237 |
| 2,695,232 | 11/1954 | Richter | 162/251 |
| 3,711,367 | 1/1973 | Christenson | 162/251 |
| 3,811,994 | 5/1974 | Ostberg | 162/19 |
| 4,061,193 | 12/1977 | Laakso et al. | 162/251 |
| 4,547,264 | 10/1985 | Sherman et al. | 162/37 |
| 4,693,785 | 9/1987 | Laakso | 162/242 |

FOREIGN PATENT DOCUMENTS

| | | | |
|---|---|---|---|
| 0893441 | 10/1953 | Fed. Rep. of Germany | 162/248 |
| 0145257 | 2/1954 | Sweden | 162/249 |

*Primary Examiner*—W. Gary Jones
*Assistant Examiner*—Dean Nguyen
*Attorney, Agent, or Firm*—Nixon & Vanderhye

[57] ABSTRACT

Enhanced uniformity of treatment of the material with a treatment liquid in a continuous treatment vessel, is provided. The invention is particularly applicable to the treatment of comminuted cellulosic fibrous material to produce paper pulp, specifically for the digesting (kraft or sulfite, or solvent pulp processing) of wood chips to produce paper pulp. The vessel has at least one annular screen divided into at least four arcuate screen segments disposed around the internal periphery of the vessel, and a first liquid having treatment properties, and a second, spent liquid, are utilized in the treatment. A second liquid is withdrawn through at least a first of the arcuate screen segments while simultaneously the first liquid through or adjacent at least a second of the arcuate screen segments opposite the first screen segment. The various screen segments are operated, and at rest, in sequence to provide the uniformity of treatment. Introduction of liquid is preferably through slots or nozzles in land area between or adjacent the screen segments, rather than through the screen segments themselves, and liquid is continuously introduced through a central vertical pipe.

10 Claims, 2 Drawing Sheets

45
CONTROLLER

46
CHEMICAL ADDITION
49
38
48
HEAT
47
37
39
29
52
30
53
35
51
23
16
17
31
28
18
54
15
25
36
23
40
50
14
19
32
27
11
10
23
21
20
55
43
57
34
33
41
56
42

DIGESTER HAVING PLURAL SCREENS WITH MEANS FOR CONTROLLING LIQUID INJECTION AND WITHDRAWAL

BACKGROUND AND SUMMARY OF THE INVENTION

In the continuous treatment of many materials, there are temperature and reactant chemical gradients that occur such that uniform treatment of the material across the cross-section of the treatment vessel is not obtained. Typically, spent liquid is withdrawn through an annular screen at the interior of the vessel, and treatment liquid is introduced into a central pipe within the vessel. When hot treatment liquid is utilized, the temperature near the wall of the vessel will be much less than in the middle, and also the chemical concentration of the liquid near the wall will be much less than in the center.

Non-uniformity in the continuous treatment of material takes place in a wide variety of continuous processes, but is especially prevalent in the cooking of comminuted cellulosic fibrous material (e.g. wood chips), as in the kraft cooking, sulfite cooking, or solvent pulping processes. Such non-uniformity can result in a non-uniform distributing of residual lignin content (e.g. measured by Kappa No.), a lower average viscosity, and lower physical strength characteristics (e.g. tensile, burst, tear, etc.) of the final product (e.g. paper or paper board) produced.

A number of techniques have been utilized commercially in order to minimize such non-uniformity of treatment in the digesting of wood chips, particularly in the kraft pulping industry. One such technique is the operation of a latter portion of the reaction zone in a countercurrent manner. However this does not eliminate the non-uniformity in chip and liquor distribution.

A number of other techniques have also been employed to enhance uniformity in continuous digesters. Typically, one or more annular screens are installed in a continuous digester for the purpose of extracting circulating liquids. Various arcuate segments of the screens are operated by others are inactive in order to withdraw liquid in a uniform manner. During normal operation it is not uncommon for screen segments to become partially plugged with either fines or over reacted particles. In order to overcome this plugging, in addition to alternate switching off or resting of one or more screen segments, sometimes backflushing of withdrawn liquid is practiced, to make a positive discharge of the fines or soft particles from the screen segments. The withdrawn liquid is typically used in backflushing although it is possible to use pressurized filtrates from other parts of the pulping process.

Typical of prior art constructions are German patent 893,441, and U.S. Pat. Nos. 2,414,062, 2,695,232, and 4,547,264. The German patent describes milled extraction screen plates which are commonly used in continuous digesters. The plates consist of multiple horizontal rows of vertically milled slots relieving toward the back. U.S. Pat. No. 2,414,062 covers a teohnique for fully heating the chip column via flow from an inlet which extends around some fraction of the circumference, through the downflowing column of chips, to an extraction sieve located opposite the inlet or inlets. Temperature distribution problems arise from utilizing this technique to perform the function of heating the chips to full reaction temperature, and thus the disclosure of U.S. Pat. No. 2,695,232 was developed. This disclosure shows the utilization of a central pipe for introducing treatment liquor into the column, and what is now considered to be a standard method of heating. This patent specifically distinguishes itself from the techniques disclosed in U.S. Pat. No. 2,414,062, which was not able to always successfully perform the function of heating the chips to full reaction temperature. The system in U.S. Pat. No. 4,547,264 was developed to reduce the temperature distribution problems existing at that time, however it results in a radial temperature distribution problem.

The invention relates to a combination of techniques wherein a moving multi-point injection of heated and fortified liquor is utilized, using limited flows at the periphery of the vessel, to significantly reduce radial temperature distributions which exist in today's digesters.

According to the present invention, the uniformity of chips and the continuous digesting thereof is enhanced by introduction of treatment liquid opposite withdrawal segments of screens in a continuous digester. While the treatment liquid can be introduced through a screen opposite one or more screens through which withdrawal is taking place, it is preferred that the treatment liquid be introduced through slots or nozzles disposed in land areas adjacent the screens.

According to one aspect of the present invention, a method of continuously uniformly treating material in a vessel is provided. The vessel has at least one annular screen, divided into at least four arcuate screen segments, disposed around the internal periphery of the vessel, and the method utilizes a first liquid having treatment properties, the first liquid ultimately becoming spent after remaining in contact with the material to produce a second, spent, liquid. The method comprises the steps of: (a) Withdrawing the second liquid through at least a first of the arcuate screen segments. (b) While practicing step (a), introducing first liquid through or adjacent at least a second of the arcuate screen segments, opposite the first screen segment. (c) Terminating steps (a) and (b). (d) Withdrawing the second liquid through at least a third of the arcuate screen segments. (e) While practicing step (d), introducing first liquid through or adjacent at least a fourth of the arcuate screen segments, opposite the third screen segment. (f) Terminating steps (d) and (e). (g) Continuously repeating steps (a)–(f) for all of the screen segments. And, (h) continuously introducing first liquid into the center of the vessel, adjacent the level of the annular screens in the vessel. Each arcuate screen segment is preferably separated from the others by a land, and each arcuate screen segment has a liquid introduction device adjacent to it, but no in liquid communication with it. Steps (b), (e) and (g) are then practiced by introducing the first liquid through the liquid introduction device adjacent the screen segment.

The method may employ for example, eight arcuate screen segments, and during the practice of steps (a), (d), and (g), second liquid is withdrawn through three adjacent screen segments at the same time (a middle and two side segments), while steps (b), (e), (g) and (h) are practiced by introducing first liquid only through the liquid introduction device associated with the screen segment opposite the middle of the withdrawing screen segments, and through a central pipe. The second liquid withdrawn during the practice of steps (a), (d), and (g) is preferably treated to increase at least one of the temperature and treatment chemical concentration thereof, to produce first liquid, and then re-introducing the first liquid in the practice of steps (b), (e), and (g). As earlier indicated, the material being treated is preferably—although not necessarily—comminuted cellulosic fibrous material, and the first liquid is the digesting liquid having a desired digesting temperature and chemical content and concentration.

According to another aspect of the present invention, apparatus is provided for treating material with a first, treatment liquid which becomes spent after prolonged contact with the material to produce second liquid. The apparatus comprises: A generally upright vessel. At least one annular screen extending around the interior periphery of said vessel at a predetermined height thereof. The screen having at least four distinct arcuate screen segments, the segments separated by lands, and each of substantially the same arcuate extent. Means for withdrawing the second liquid through at least a first of the arcuate screen segments. Means for introducing first liquid through or adjacent at least a second of the arcuate screen segments, opposite the first screen segment, simultaneously with the withdrawal of second liquid through the first screen segment. Control means for controlling the withdrawing and introducing means to periodically change the screens through which withdrawal takes place, and through which, or adjacent to to which, introduction of first liquid takes place. And, a central vertical pipe for introducing first liquid into the vessel adjacent the annular screen, and preferably two vertically spaced annular screens are provided. Means for introducing the first liquid preferably comprises a liquid introduction device adjacent each of the screens, the liquid introduction device comprising a horizontally elongated slot or a plurality of nozzles, which can be easily vertically spaced from the segment with which it is associated, or located in land area between the screen segment with which it is associated and adjacent screens segments.

It is the primary object of the present invention to provide a method and apparatus for simply yet effectively increasing the uniformity of treatment of the material with treatment liquid, particularly the digestion of wood chips or the like or produce paper pulp. This and other objects of the invention will become clear from an inspection of the detailed description of the invention, and from the appended claims.

DETAILED DESCRIPTION OF THE DRAWINGS

Figure 1:
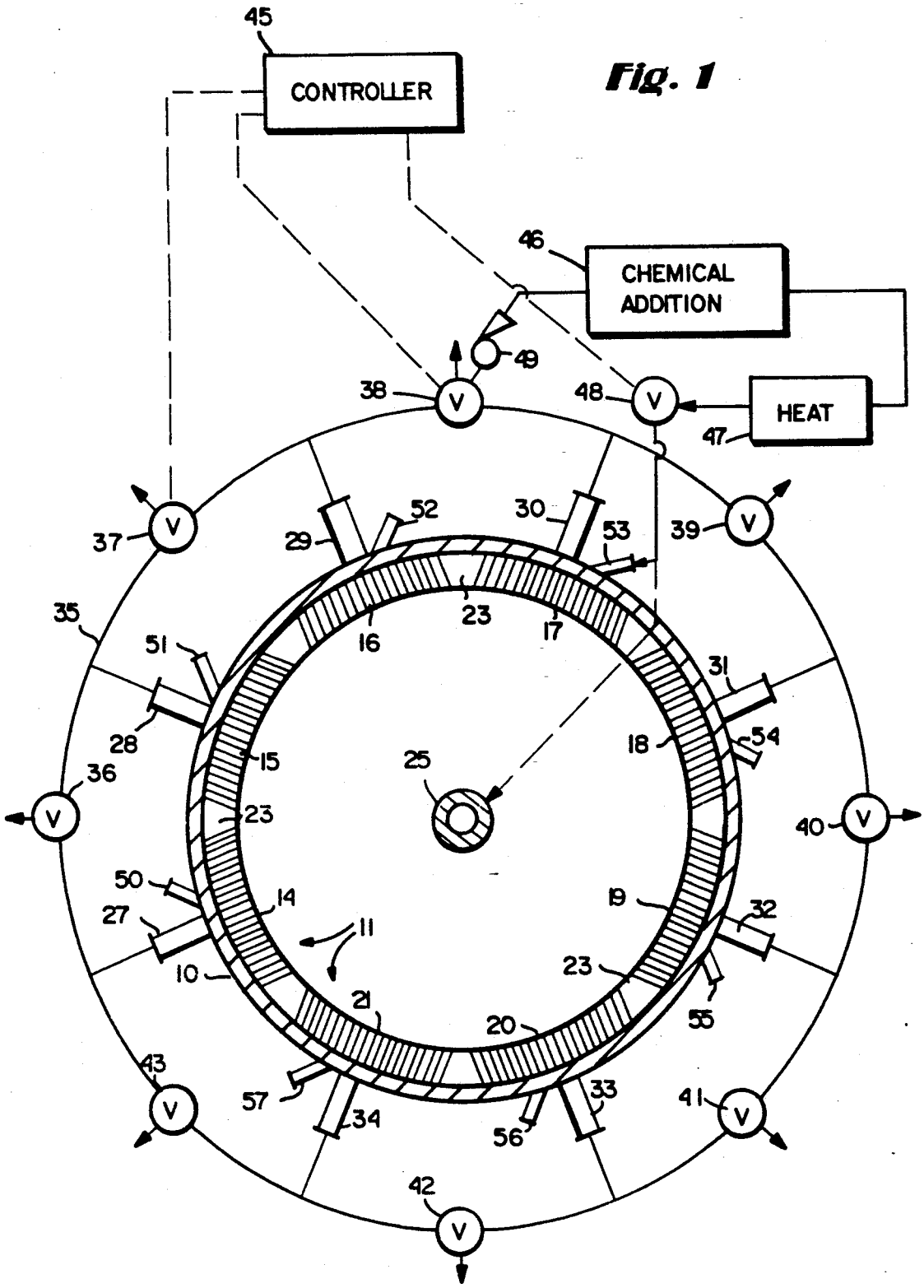
FIG. 1 is a top sectional schematic view taken through an exemplary digester according to the invention just above an annular screen therein.

The apparatus according to the invention is illustrated in the drawings will be particularly described as a continuous digester for producing paper pulp from comminuted cellulosic fibrous material. However it is to be understood that other treatment vessels could also be utilized for the treatment of other types of materials.

The vessel 10 is a generally upright vessel, comprising a conventional continuous digester except for the particular construction of the screens, and method of utilization thereof, according to the invention. The vessel 10 includes at least one annular screen 11, preferably a pair of annular screens 11, 12—which cooperate with each other— being provided. Each annular screen 11, 12 is broken up into a plurality of individual arcuate screen segments through which withdrawal of liquid can take place independently of the other screens. For the exemplary embodiment illustrated in FIG. 1, eight different arcuate screen segments are provided, 14 through 21. In the preferred embodiment of the present invention, land areas—which are not operable as screen segments—23 are provided between the screen segments 14 through 21.

As is conventional per se, the vessel 10 also has a central pipe 25 through which treatment liquid is introduced, the pipe 25 terminating at the bottom end thereof adjacent the screens 11, 12. Each of the screen segments 14 through 21 is connected up to an outlet, as indicated by the reference numerals 27 through 34, and the outlets 27 through 34 may be connected to a header 35 or the like, and remote control valves 36 through 43 may be associated with each of the screen segments 14 through 21, respectively. The controller 45 controls operations of the valves 36 through 43, and the liquid withdrawn through the valve preferably is treated so that the chemical concentration thereof is enhanced at stage 46 (see FIG. 1), and/or the withdrawn liquid is heated or otherwise temperature-modified, as illustrated at 47 in FIGS. 1 and 3. The controller 45 may also control a valve 48 for effecting return of the withdrawn and enhanced liquid, as will be hereafter described. Each of the valves 36 through 43 may cooperate with a chemical addition stage or heating stage 46, 47, as described above with respect to the valve 38. Withdrawal from the outlets 27 through 34 typically takes place utilizing a pump, such as the pump 49 illustrated schematically in FIGS. 1 and 3.

According to the present invention, means are provided for introducing treatment liquid into the vessel 10 at a point opposite the withdrawal of liquid from the vessel 10. For this purpose, a number of inlets, shown schematically by reference numerals 50 through 57 in FIG. 1 are provided. While the liquid introduction conduits 50 through 57 may introduce liquid into a screen segment 14 through 21 to backflush it, degradation of the screen may occur if it is used for that purpose in the adverse environment of a commercial digester. Therefore it is preferred that the liquid introduction through the conduits 50 through 57 take place in liquid introduction devices adjacent, but spaced from, the screen segments 14 through 21.

The inlets 50–57 are shown as slanted in FIG. 1 for clarity of illustration. However, they typically are perpendicular to the wall of the vessel 10, as seen for inlet 54 in FIG. 3.

Figure 2:
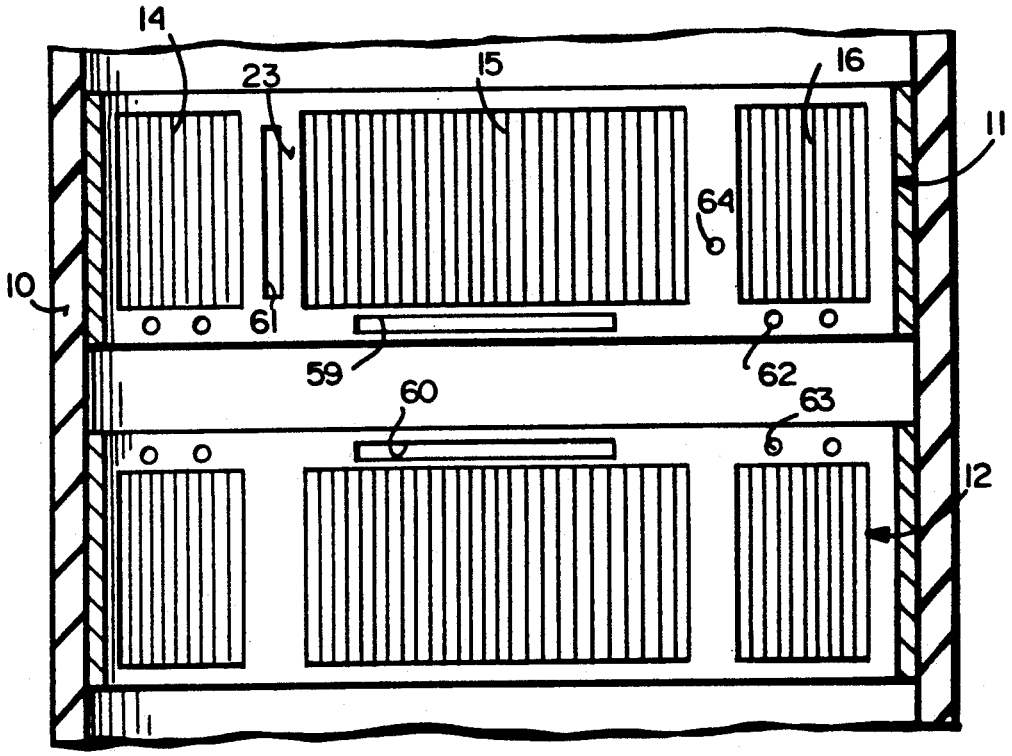
FIG. 2 is a longitudinal sectional view of the section of the digester of FIG. 1 at the screens.

Various forms of the liquid introduction devices could take are illustrated in FIG. 2. Preferably the liquid introduction device either comprises a slot—such as the horizontally elongated slots 59, 60, vertical slot 61, or nozzles, such as the nozzles 62, 63, 64.

The slots may be provided in the land area below a screen segment 15—as for the slot 59—or above screen segment—as illustrated by slot 60 —or in the land area between adjacent screen segments—as illustrated by the slot 61 in the land area 23 in FIG. 2. The slots 59, 60, 61 typically have a large volume or area, i.e. significantly larger than that of conventional vertically milled slots in conventional extraction screen plates.

The nozzles can be located similarly to the slots. The nozzle 62 is below the screen segment 16, the nozzle 63 is above a screen segment, and the nozzle 64 is in the land area between the screen segments 15, 16, in FIG. 2.

According to the invention, at least four screen segments 14 through 21 are provided, so that a screen segment is "opposite" one or more screen segments for facilitating maximum uniformity of treatment. In an actual commercial installation, typically eight or twelve screen segments 14 through 21 for each annular screen 11, 12 are provided.

In order to provide uniformity of treatment according to the invention, withdrawal takes place through one or more screen segments on one side of the interior wall of the vessel 10, while liquid introduction takes place opposite the withdrawal. For example for the construction as illustrated in FIG. 1, if withdrawal takes place through screen segments 14 through 16 at the same time, liquid is introduced through or adjacent screen segment 19, through liquid introduction conduit 55 associated therewith. The liquid being withdrawn is spent digesting liquid—where the vessel 10 is a continuous digester—while the liquid being introduced through or adjacent the screen segment 19 —opposite the screen segment 15 (the middle of the screen segments 14 through 16 through which withdrawal is taking place) is digesting liquid, having a high temperature and/or chemical concentration compared to the second, spent liquor being withdrawn through the screen segments 14 through 16. While this operation takes place, the screen segments 17, 18, 20, and 21 are inactive. After a predetermined period of time, controller 45 switches which of the screens withdrawal takes place through, and which of the screen segments liquid introduction takes place through or near. For example, typically withdrawal would terminate through screen 14, and be started through screen 17 so that withdrawal took place through screens 15 through 17, while liquid introduction would take place through screen segment 20, while screen segment 19 was inactive, digesting liquid being fed through inlet conduit 56 to introduce liquid through or adjacent the screen segment 20. During this entire time, liquid is continuously introduced by central pipe 25.

While the exact sequence of withdrawal and introduction can be varied to suit the purposes of the particular installation, one particular sequence for an eight screen segment continuous digester 10 is as follows, the screen segments being numbered 1 through 8, with the screen segments sequentially numbered around the internal circumference of the vessel 10 (i.e. screen segment 1 is opposite screen segment 5, etc.):

| | Injecting Point | Extraction Segments | | |
|---|---|---|---|---|
| Period 1 | 1 | 4 | 5 | 6 |
| Period 2 | 2 | 5 | 6 | 7 |
| Period 3 | 3 | 6 | 7 | 8 |
| Period 4 | 4 | 7 | 8 | 1 |
| Period 5 | 5 | 8 | 1 | 2 |
| Period 6 | 6 | 1 | 2 | 3 |
| Period 7 | 7 | 2 | 3 | 4 |
| Period 8 | 8 | 3 | 4 | 5 |
| Repeat 1-8 | | | | |

Figure 3:
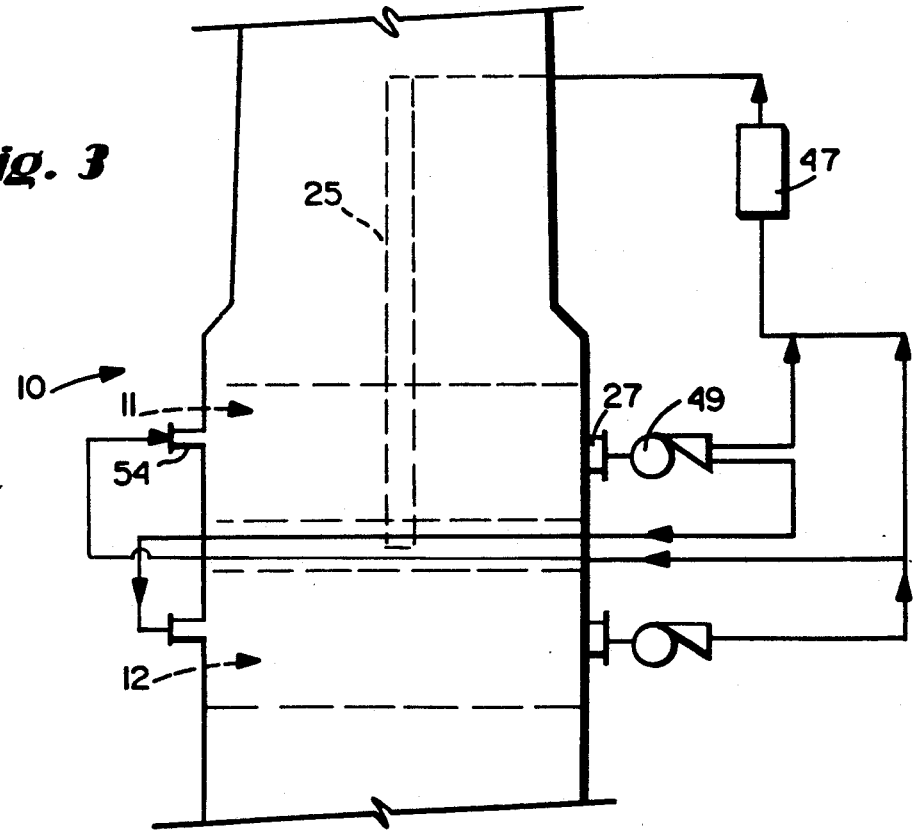
FIG. 3 is a schematic side view of the portion of interest of the continuous digester according to the invention.

The above description is for the case where one annular screen 11 is provided. If two adjacent, but vertically spaced, screens 11, 12 are provided—as illustrated in FIGS. 2 and 3—there can be cooperation between the annular screens 11, 12 themselves so as to provide even more uniformity of treatment. For example if there are two bands of eight screen segments each with the relative screen segment locations being numbered sequentially around the internal periphery of the vessel 10, and located as follows:

| | | | | | | | | |
|---|---|---|---|---|---|---|---|---|
| Band 1 | 1 | 2 | 3 | 4 | 5 | 6 | 7 | 8 |
| Band 2 | 9 | 10 | 11 | 12 | 13 | 14 | 15 | 16; |

then an exemplary extraction and extraction sequence could be as follows:

| | Injecting Point | | Extraction Segments | | | |
|---|---|---|---|---|---|---|
| Period 1 | 1 | 2 | 12 | 13 | 14 | 15 |
| Period 2 | 11 | 12 | 6 | 7 | 8 | 1 |
| Period 3 | 3 | 4 | 14 | 15 | 16 | 9 |
| Period 4 | 13 | 14 | 8 | 1 | 2 | 3 |
| Period 5 | 5 | 6 | 16 | 9 | 10 | 11 |
| Period 6 | 15 | 16 | 2 | 3 | 4 | 5 |
| Period 7 | 7 | 8 | 10 | 11 | 12 | 13 |
| Period 8 | 9 | 10 | 4 | 5 | 6 | 7 |
| Repeat 1-8 | | | | | | |

As earlier indicated, there is preferably land area 23 between the screen segments, and also above and below the screen segments. This solid, non-perforated land area reduces the channeling of circulating liquor from the injection point to and through adjacent inactive screens, behind the adjacent screens around to the active screens. It also facilitates movement of the liquid through the porous packed column of solids in the vessel 10.

It will thus be seen that according to the present invention, a method and apparatus have been provided for enhanced uniformity of treatment of material with a treatment liquid—particularly the treatment of comminuted cellulosic fibrous material with a digesting liquor, as in kraft or sulfite pulping, or solvent pulp processing. While the invention has been herein shown and described in what is presently conceived to be the most practical and preferred and embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Apparatus for treating material with first, treatment, liquid, which becomes spent after prolonged contact with the material to produce a second liquid, comprising:

a generally upright vessel;

at least one annular screen extending around the interior periphery of said vessel at a predetermined height thereof;

said screen having at least four distinct arcuate screen segments, said segments separated by land area between them, and wherein there is land area above and below said screen segments, and said screen segments are each of substantially the same arcuate extent;

means for withdrawing the second liquid through at least a first of the arcuate screen segments;

means for withdrawing the second liquid through at least a first of the arcuate screen segments;

means including in said land area between screen segments, and comprising at least one horizontally extending slot in part of said land area, for introducing first liquid between said screen segments, including at least a second of the arcuate screen segments, opposite the first screen segment, simultaneously with the withdrawal of second liquid through said first screen segment;

control means for controlling said withdrawing and introducing means to periodically change the screens through which withdrawal takes place, and through which, or adjacent to which, introduction of first liquid takes place; and a central vertical pipe for introducing first liquid into said vessel adjacent said annular screen.

2. Apparatus as recited in claim 1 wherein said at least one annular screen comprises two annular screens vertically spaced from, but close to, each other, and functionally cooperating.

3. Apparatus as recited in claim 1 wherein said liquid introduction means further comprise a plurality of nozzles.

4. Apparatus as recited in claim 1 wherein said liquid introduction slot is vertically spaced from said screen segment with which it is associated.

5. Apparatus for treating material with first, treatment, liquid, which becomes spent after prolonged contact with the material to produce a second liquid, comprising:

a generally upright vessel;

at least one annular screen extending around the interior periphery of said vessel at a predetermined height thereof;

said screen having at least four distinct arcuate screen segments, said segments separated by lands, and each of substantially the same arcuate extent, land area being provided between said screen segments, and above and below them;

means for withdrawing the second liquid through at least a first of the arcuate screen segments;

means, including in said land area between screens, for introducing first liquid between, but not through, at least a second of the arcuate screen segments, opposite the first screen segment, simultaneously with the withdrawal of second liquid through said first screen segment, said means comprising at least one horizontally extending slot in said land area;

a pipe located centrally within said vessel for introducing first liquid at approximately the level of said annular screen; and control means for controlling said withdrawing and introducing means to periodically change the screens through which withdrawal takes place, and through which, or adjacent to which, introduction of first liquid takes place.

6. Apparatus as recited in claim 5 wherein said at least one annular screen comprises two annular screens vertically spaced from, but close to, each other, and functionally cooperating, and wherein said horizontally extending slot is disposed in land area between said two annular vertically spaced screens.

7. Apparatus as recited in claim 5 wherein said liquid introduction means further comprise a plurality of nozzles.

8. Apparatus for treating material with first, treatment, liquid, which becomes spent after prolonged contact with the material to produce a second liquid, comprising:

a generally upright vessel;

at least one annular screen extending around the interior periphery of said vessel at a predetermined height thereof;

said screen having at least four distinct arcuate screen segments, said segments separated by land area between them, and wherein there is land area above and below said screen segments, and said screen segments are each of substantially the same arcuate extent;

means for withdrawing the second liquid through at least a first of the arcuate screen segments;

means including in said land area between screen segments, and comprising at least one vertically extending slot in part of said land area, for introducing first liquid between said screen segments, including at least a second of the arcuate screen segments, opposite the first screen segment, simultaneously with the withdrawal of second liquid through said first screen segment;

control means for controlling said withdrawing and introducing means to periodically change the screens through which withdrawal takes place, and through which, or adjacent to which, introduction of first liquid takes place; and a central vertical pipe for introducing first liquid into said vessel adjacent said annular screen.

9. Apparatus for treating material with first, treatment, liquid, which becomes spent after prolonged contact with the material to produce a second liquid, comprising:

a generally upright vessel;

at least one annular screen extending around the interior periphery of said vessel at a predetermined height thereof;

said screen having at least four distinct arcuate screen segments, said segments separated by land area between them, and wherein there is land area above and below said screen segments, and said screen segments are each of substantially the same arcuate extent;

means for withdrawing the second liquid through at least a first of the arcuate screen segments;

means including in said land area between screen segments, and comprising a plurality of nozzles in said land area, for introducing first liquid between said screen segments, including at least a second of the arcuate screen segments, opposite the first screen segment, simultaneously with the withdrawal of second liquid through said first screen segment;

control means for controlling said withdrawing and introducing means to periodically change the screens through which withdrawal takes place, and through which, or adjacent to which, introduction of first liquid takes place; and a central vertical pipe for introducing first liquid into said vessel adjacent said annular screen.

10. Apparatus for treating materials with first, treatment, liquid, which becomes spent after prolonged contact with the material to produce a second liquid, comprising:

a generally upright vessel;

at least one annular screen extending around the interior periphery of said vessel at a predetermined height thereof;

said screen having at least four distinct arcuate screen segments, said segments separated by lands, and each of substantially the same arcuate extent, land area being provided between said screen segments, and above and below them;

means for withdrawing the second liquid through at least a first of the arcuate screen segments;

means, including in said land area between screens, for introducing first liquid between, but not through, at least a second of the arcuate screen segments, opposite the first screen segment, simultaneously with the withdrawal of second liquid through said first screen segment, said means comprising a plurality of nozzles in said land area;

a pipe located centrally within said vessel for introducing first liquid at approximately the level of said annular screen; and control means for controlling said withdrawing and introducing means to periodically change the screens through which withdrawal takes place, and through which, or adjacent to which, introduction of first liquid takes place.

* * * * *